US006515570B2

(12) United States Patent
Kaltenborn et al.

(10) Patent No.: US 6,515,570 B2
(45) Date of Patent: Feb. 4, 2003

(54) FUSE WITH OVERSTOICHIOMETRIC AMOUNT OF OXIDANT

(75) Inventors: Uwe Kaltenborn, Remetschwil (CH); Ralf Strümpler, Gebenstorf (CH); Joachim Glatz-Reichenbach, Baden (CH); Felix Greuter, Baden-Rütihof (CH)

(73) Assignee: ABB Research Ltd, Zurich (CH)

( * ) Notice: Subject to any disclaimer, the term of this patent is extended or adjusted under 35 U.S.C. 154(b) by 103 days.

(21) Appl. No.: 09/731,931

(22) Filed: Dec. 8, 2000

(65) Prior Publication Data

US 2001/0019300 A1 Sep. 6, 2001

(30) Foreign Application Priority Data

Dec. 8, 1999 (DE) ..... 199 59 243

(51) Int. Cl.[7] ..... H01H 85/04; C06C 5/00

(52) U.S. Cl. ..... 337/290; 337/142; 337/159; 337/401; 102/275.6

(58) Field of Search ..... 337/142, 158, 337/159, 161, 186, 227–229, 273, 280, 401, 404, 406, 290; 361/103, 104; 102/275.6, 275.9

(56) References Cited

U.S. PATENT DOCUMENTS

| | | | | |
|---|---|---|---|---|
| 1,867,924 A | | 7/1932 | Roberts et al. | |
| 3,705,373 A | | 12/1972 | Cameron | |
| 4,099,153 A | | 7/1978 | Cameron | |
| 4,220,087 A | * | 9/1980 | Posson | 102/275.6 |
| 4,319,212 A | | 3/1982 | Leach | |
| 4,486,734 A | | 12/1984 | Leach | |
| 4,544,908 A | | 10/1985 | Blewitt et al. | |
| 4,638,283 A | | 1/1987 | Frind et al. | |
| 5,406,245 A | * | 4/1995 | Smith et al. | 218/150 |
| 5,714,923 A | | 2/1998 | Shea et al. | |
| 5,831,512 A | * | 11/1998 | Wienand et al. | 338/22 R |
| 6,005,470 A | * | 12/1999 | Smith et al. | 337/273 |

FOREIGN PATENT DOCUMENTS

| | | |
|---|---|---|
| AU | 468188 | 12/1975 |
| CH | 312607 | 1/1956 |
| DE | 511453 | 10/1930 |
| DE | 959568 | 3/1957 |
| DE | 32 37 326 | 4/1984 |
| DE | 198 24 851 | 12/1999 |
| EP | 0 641 005 | 3/1995 |
| EP | 0 657 910 | 6/1995 |
| GB | 1166037 | 10/1969 |

* cited by examiner

*Primary Examiner*—Jayprakash N. Gandhi
(74) *Attorney, Agent, or Firm*—Burns, Doane, Swecker & Mathis, L.L.P.

(57) ABSTRACT

A fuse has a fuse element (6), composed of silver, with constrictions (7) which follow one another at regular intervals, and which fuse element makes contact with a combustible element (8), preferably over its entire length. The combustible element (8) is composed of a combustion compound, which is essentially of a fuel such as guanidine or a guanidine derivative and a metal such as Mg or Al and an oxidant such as $KNO_3$, $NaNO_3$, $NH_4NO_3$, $KClO_4$, $NaClO_4$, $KMnO_4$, the proportion of which is overstoichiometric by a factor of at least 1.1, and preferably of at least 10. The combustible compound also preferably contains a binding agent such as paraffin, a thermoplastic or an elastomer, so that it can be extruded. It has an ignition temperature of between 160° C. and 260° C. and emits more than 200 J/g of heat, so that it ignites even in the event of small overcurrents and melts the entire length of the fuse element (6).

28 Claims, 4 Drawing Sheets

FUSE WITH OVERSTOICHIOMETRIC AMOUNT OF OXIDANT

FIELD OF INVENTION

This application claims priority under 35 U.S.C. §§ 119 and/or 365 to Appln. No. 199 59 243.8 filed in Germany on Dec. 8, 1999; the entire content of which is hereby incorporated by reference.

The invention relates to a fuse for the medium-voltage and high-voltage areas. Such fuses are used to interrupt overcurrents, such as those which occur as a result of short circuits.

BACKGROUND OF THE INVENTION

U.S. Pat. No. 4,638,283 discloses a fuse of this generic type which has a core with a cruciform cross section in a housing, which core is composed of electrically insulating material and around which fuse elements in the form of strips are wound in the form of a helical line. The core is fitted axially with rings which follow one another spaced apart and which each have a depression where they are crossed by a fuse element, in which depression a combustible body is arranged which contains an igniter, for example composed of $KClO_4$, in particular with a boron additive, and, apart from this, is composed of a combustible material, for example aluminum, $KClO_4$ and silicagel as a binding agent. An ignition circuit which connects the connections to one another and is composed of a wire with a relatively high resistance connects each row of combustible bodies which follow one another axially, where the wire passes through the igniter. An element which evolves gas and is composed of hydratized aluminum silicate, boron phosphate and a binding agent, and optionally zirconium, is also fitted on the fuse element. The housing is filled with an extinguishing means, for example quartz sand. If a fuse element melts at any point, considerably more current flows through the ignition circuit, so that the combustible body is caused to ignite, and the fuse elements are interrupted at a row of points which are spaced axially apart from one another.

A fuse of similar construction is disclosed in U.S. Pat. No. 4,486,734. There, the combustible material is a mixture of a metal such as Zr, Hf, Th, Al, Mg as a material which burns, an oxidant such as $KClO_4$ or some other perchlorate or chlorate, and a binding agent such as silicagel.

In a further fuse of similar construction (U.S. Pat. No. 4,319,212), incisions on the outsides of the ribs of the core, over which fuse elements run, are filled with a combustible material, for example with a mixture of aluminum or magnesium oxide and a filler such as mica, glass fiber, asbestos or quartz powder, and a binding agent such as polyester.

In another fuse (EP-A-0 641 005), the core is coated with a combustible material which is composed of a material which evolves gas, such as guanidine carbonate or acetate, diphenylguanidine, a guanine, melamine, hydantoin or allantoin derivative or a cyanurate and a film-forming polymer such as polyurethane, acrylic, melamine or melamine formaldehyde resin as a binding agent. Furthermore, it may contain hydratized aluminum, $CaCO_3$, boric acid or $Mg(OH)_2$ as an additive.

According to EP-A-0 657 910, the housing of an otherwise similar fuse is filled with a sand whose grains are coated with a mixture of a combustible material, which is composed of a gas-evolving material such as guanidine, guanidine carbonate or acetate, 1,3-diphenylguandine, guanine, melamine, urea, hydantoin or allantoin, and a binding agent such as urethane, melamine, epoxy resin, polyester or, in particular, acryl.

According to U.S. Pat. No. 4,099,153, a fuse wire is wound in the form of a helical line around a core composed of four parallel rods and is clamped against one of the rods in each case by means of a number of brackets, which are composed of a material that emits gas and are pushed axially onto the core, following one another spaced apart.

U.S. Pat. No. 3,705,373 discloses a fuse having a fuse element in strip form, which is weakened by holes at a number of successive points, and at one of these is also weakened by a layer of material with a low melting point, such as Sn or Cd. A wire with, for example, an aluminum core and a Pd sheath is located parallel to this. If the fuse element melts through at any point, then so much current flow through the wire that the aluminum core melts and reacts explosively with the Pd sheath, as a result of which the fuse element is interrupted at a number of points.

A common feature of all the described fuses is that they respond only when at least one fuse element has melted through. They are thus suitable only for interruption of large overcurrents—in general greater than approximately three times the rated current—which cause such melting through. However, smaller overcurrents cannot be interrupted by such fuses, or at least not reliably and sufficiently quickly.

SUMMARY OF THE INVENTION

The invention is based on the object of specifying a fuse which responds quickly and reliably, and interrupts the current reliably, even in response to small overcurrents.

The fuse according to the invention responds well before a fuse element melts through. Once it has responded, its resistance rises dramatically, thus resulting in rapid interruption of even relatively small overcurrents, in particular in the critical range between 1.1 and three times the rated current.

BRIEF DESCRIPTION OF THE DRAWINGS

Preferred embodiments of the invention are disclosed in the following description and illustrated in the accompanying drawings, in which.

DETAILED DESCRIPTION OF THE INVENTION

Figure 1B:
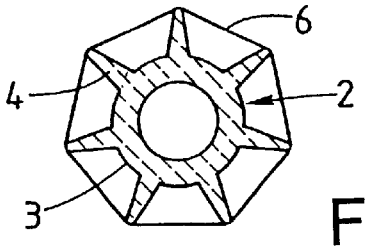
FIG. 1*b* shows a cross section along B—B in FIG. 1*a,*
Figure 1A:
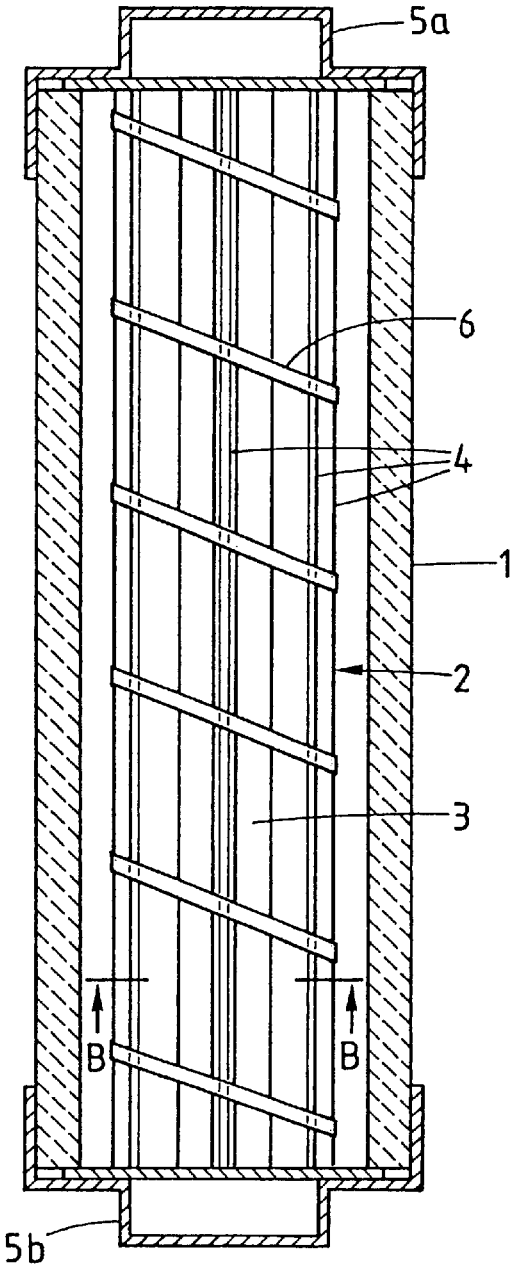
FIG. 1*a* shows a longitudinal section through a first embodiment of a fuse according to the invention.

In a cylindrical housing 1 which may be composed, for example, of ceramic, the fuse according to the invention has in it (FIGS. 1*a, b*) a supporting body 2 which is arranged on the axis, is likewise composed of ceramic or else plastic or a composite material or else of some suitable electrically insulating material, and has a cylindrical or tubular base body 3 with radially projecting ribs 4. A first electrical connection and a second electrical connection are arranged at the mutually opposite ends of the housing 1 and are in the form of caps 5*a, b,* composed of metal. The caps 5*a, b* are electrically conductively connected by means of a fuse element 6—which may also be a number of fuse elements connected in parallel—wound in the form of a helical line around the supporting body 2. The housing is filled with an extinguishing means such as quartz sand.

According to a first embodiment, the fuse element 6 is in each case in the form of a strip of a suitably electrically conductive material which can melt, preferably composed of silver or a silver alloy, or else copper or aluminum. The fuse element 6 has constrictions 7 at regular intervals, which constrictions 7 are formed by mutually opposite semicircular recesses. Instead of recesses, stamped-out areas can also be provided, the primary factor being that the cross section is reduced in size.

The fuse also has a combustible element 8, which extends essentially over the entire length between the caps 5*a* , 5*b*. This combustible element 8 is composed essentially of a combustible material which contains a fuel and an oxidant which react with one another on reaching an ignition temperature, which is not greater than 260° C., with a relatively large amount of heat being released.

The fuel used is preferably a material which releases a large amount of extinguishing gas on combustion. Guanidine and guanidine derivatives such as diguanidinium 5,5'-azotetrazolate (GZT), guanidine nitrate and guanidine acetate have proved to be particularly useful for this purpose, and mixtures of them can also be used. An additive, composed of at least one metal as Mg, Al, Zr, Hf, Th can also be included in order to increase the amount of heat released. Oxygen-rich compounds are suitable for use as the oxidant, particularly nitrates, chlorates, perchlorates and permanganates such as $KNO_3$, $NaNO_3$, $NH_4NO_3$, $KClO_4$, $NaClO_4$ $KMnO_4$. If an additive is included in the fuel, it is advantageous to add to the oxidant a metal oxide which enters into a thermitic reaction with at least one of the metals contained therein, for example $Fe_2O_3$. The combustible material contains an overstoichiometric amount of oxidant, with the proportion of said oxidant generally being overstoichiometric by a factor of at least 1.1, but preferably by a higher ratio, for example between 10:1 and 15:1. This leads to complete oxidation of the fuel in a reaction that takes place very quickly.

Selection and metering of the oxidant in such a way that it releases a sufficient amount of oxygen at a specific temperature allow the ignition temperature of the combustible material to be set with relatively high accuracy—in general to ±10° C. In this case, values between 160° C. and 260° C. are preferable, and preferably not more than 240° C. The amount of heat released is at least 200 J/g, and preferably at least 300 J/g. Any metals which may be contained in the fuel are likewise raised to their ignition temperature by the combustion of the organic component, which starts before this, and then make a considerable contribution to the amount of heat released. Temperatures of 1700° C. or more are reached.

The following combustible materials have been investigated, by way of example (the proportions are quoted in % by mass):

1: 60% GZT, 40% $KMnO_4$
2: 40% GZT, 6% Mg, 54% $KMnO_4$
3: 30% GZT, 3.5% guanidine nitrate, 66.5% $KMnO_4$
4: 7.1% guanidine acetate, 92.9% $KMnO_4$
5: 33.3% guanidine nitrate, 11.1% Mg, 55.6% $KMnO_4$
6: 27.5% guanidine nitrate, 9.2% Mg, 16.7% PSA, 46.7% $KMnO_4$
7: 27.5% guanidine nitrate, 16.7% guanidine acetate, 9.2% Mg, 46.7% $KMnO_4$
8: 26.8% GZT, 13.4% guanidine acetate, 59.8% $KMnO_4$ In the process, the following values have been obtained for the ignition temperature and the amount of heat released:

| Combustible material | Ignition temperature [° C.] | Amount of heat released [J/g] |
|---|---|---|
| 1 | 255 | 330 |
| 2 | 258 | 580 |
| 3 | 177 | 862 |
| 4 | 208 | 402 |
| 5 | 236 | 714 |
| 6 | 160 | 294 |
| 7 | 205 | 862 |
| 8 | 233 | 760 |

Figure 2A:
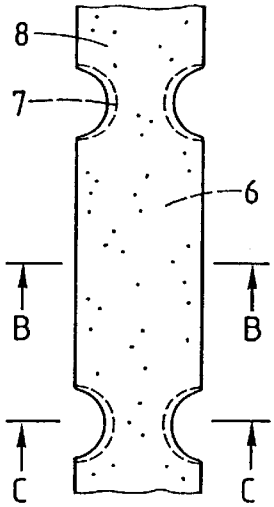
FIG. 2*a* shows a plan view of a first embodiment of a fuse element of the fuse shown in FIGS. 1*a,* 1*b,*
Figure 2B:
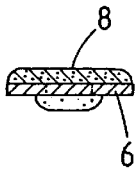
FIG. 2*b* shows a section along B—B of the first embodiment of the fuse element as shown in FIG. 2*a,*
Figure 2C:
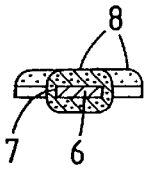
FIG. 2*c* shows a section along C—C of the first embodiment of the fuse element as shown in FIG. 2*a,*
Figure 3B:
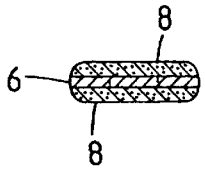
FIG. 3*b* shows a section corresponding to that shown in FIG. 2*b* through a second embodiment of the fuse element.
Figure 3C:
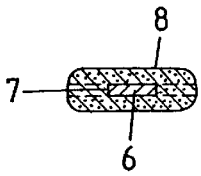
FIG. 3*c* shows a section corresponding to that shown in FIG. 2*c* through the second embodiment of the fuse element.

In order to achieve favorable mechanical characteristics, the combustible material may also contain a binding agent, which makes it possible, for example, to stretch or extrude the combustible material. Paraffin or beeswax, polyester or polyethylene are particularly suitable for this purpose. The binding agent is heated until it can be kneaded, and is then mixed with the fuel and the oxidant using a kneading tool. Furthermore, known binders such as polyethylenes, polyamides, polyimides, or inorganic materials such as silicagel or waterglass can also be used as binding agents in conjunction with pyrotechnics. Particularly in this case, a granulate can also be produced from the fuel and the oxidant, and then be mixed with the binding agent. The mixture can be applied to the fuse element 6, which is in strip form, over its entire length, for example by extrusion, so that the combustible element 8 makes close mechanical and thermal contact with the fuse element 6 over its entire length. For example, it can be applied (FIGS. 2*a, b, c*) to one of the surfaces of the fuse element 6 so that it completely covers this surface, in which case the fuse element 6 can also be completely surrounded in the region of the constrictions 7, or layers (FIGS. 3*b, c*) of constant width can be applied to both surfaces of the fuse element 6, with these layers being connected to one another in the region of the constrictions 7 so that the combustible element 8 largely sheaths the fuse element 6.

Figure 4A:
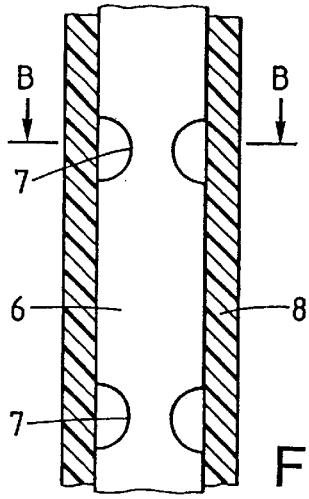
FIG. 4*a* shows a longitudinal section through a third embodiment of a fuse element of the fuse shown in FIGS. 1*a,* 1*b,*
Figure 4B:
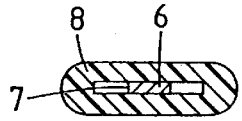
FIG. 4*b* shows a section along B—B in FIG. 4*a,*
Figure 5A:
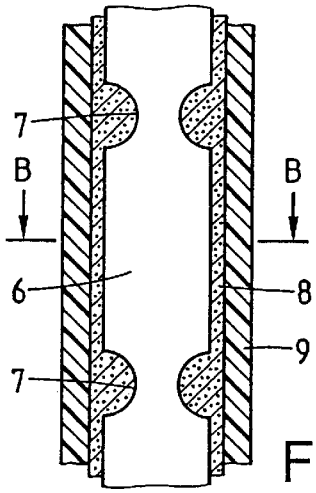
FIG. 5*a* shows a longitudinal section through a fourth embodiment of a fuse element of the fuse shown in FIGS. 1*a,* 1*b,*
Figure 5B:
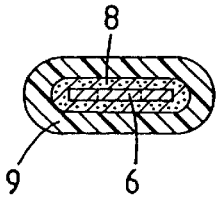
FIG. 5*b* shows a section along B—B in FIG. 5*a,*

Another option is to add elastomers which are crosslinked at temperatures above room temperature, for example between 40° C. and 130° C., for example silicon or else materials which shrink to a major extent when heated to such temperatures, in particular polymers such as polyethylene or polypropylene, as binding agents which are likewise mixed with the fuel and the oxidant. The combustible element 8 can then (FIGS. 4*a, b*) be put into the form of shrink sleeving which is pulled over the fuse element 6 and is crosslinked or shrunk.

It is also possible to provide a separate shrink sleeving 9, which is pulled over the fuse element 6 and the combustible element 8. The combustible material does not need to have any binding agent added in this case.

Figure 6B:
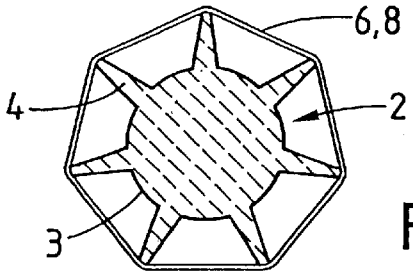
FIG. 6*b* shows a cross section along B—B in FIG. 6*a,*
Figure 6A:
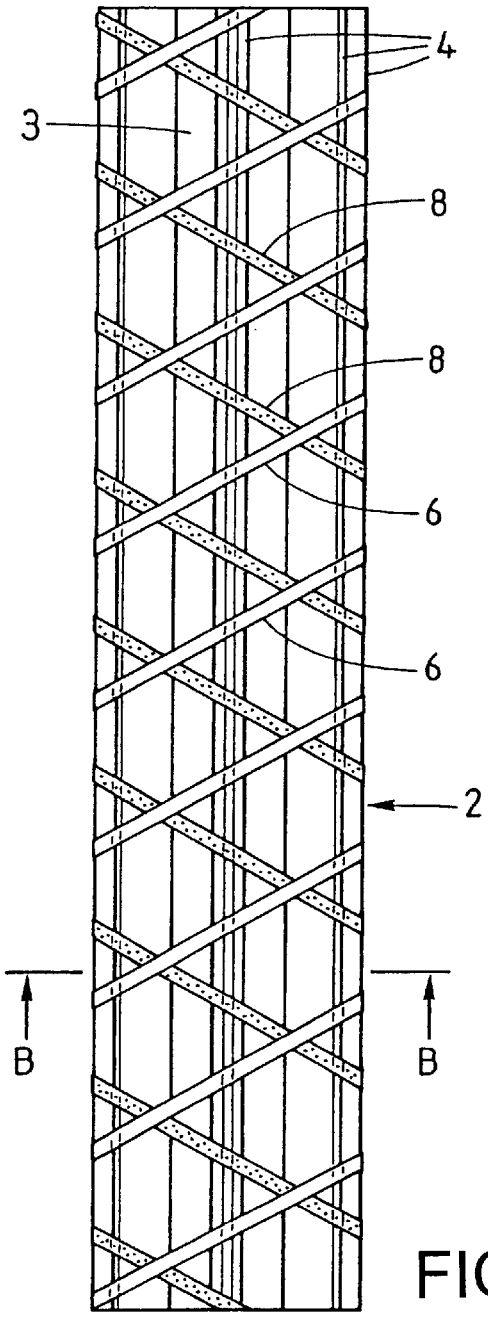
FIG. 6*a* shows a plan view of a part of a second embodiment of a fuse according to the invention.

However, other embodiments are also possible, in which the combustible element 8 does not follow the fuse element 6 over its entire length but makes contact with it only at a number of points which are spaced apart from one another in the longitudinal direction. As shown in FIGS. 6*a, b,* two combustible elements 8 in the form of strips are formed and are wound in the form of a helical line around the supporting body 2, in the same way as the two fuse elements 6 which are also in the form of strips composed of a suitable, highly conductive material, but with the combustible elements 8 being wound in the opposite rotation direction, so that they cross the fuse elements 6 a number of times. The combustible elements 8 in this case each comprise a base strip which is composed of a material such as fiberglass or some other suitable electrically non-conductive material which is resistant at least to the ignition temperature, and with the combustible material, which is extruded in the form of strips on one or both sides, being pressed against the base strip, to which it is fitted.

Figure 7B:
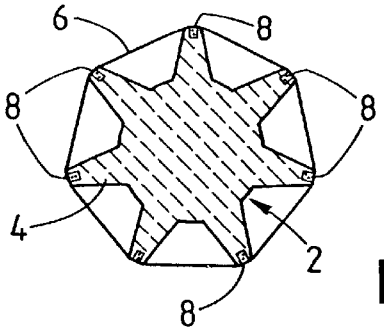
FIG. 7*b* shows a cross section along B—B in FIG. 7*a,*
Figure 7A:
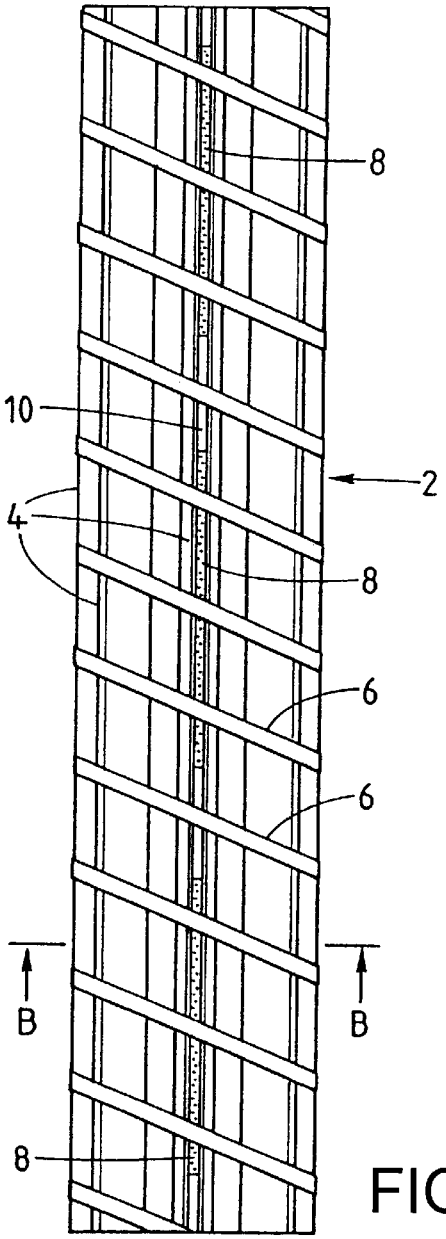
FIG. 7*a* shows a plan view of a part of a third embodiment of a fuse according to the invention.
Figure 7C:
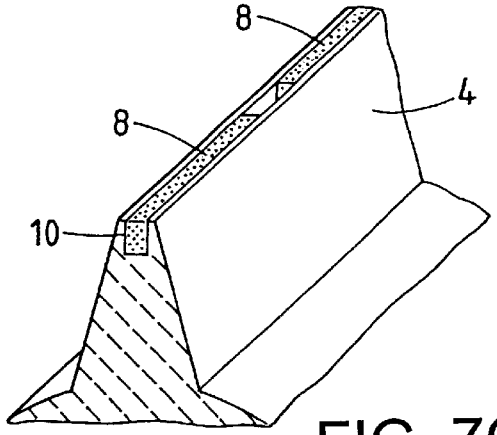
FIG. 7*c* shows a detail of a perspective illustration of a part of the third embodiment of the fuse according to the invention.
Figure 7D:
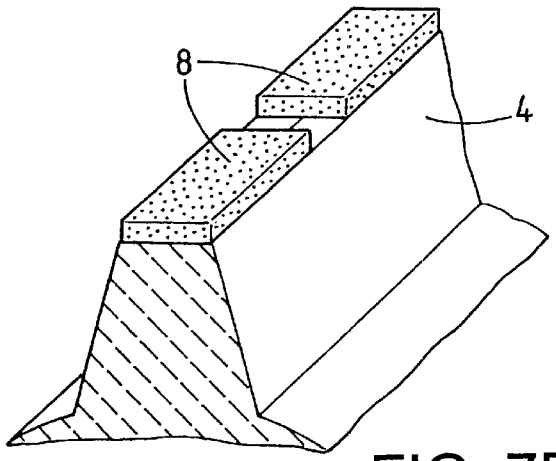
FIG. 7*d* shows an illustration, corresponding to FIG. 7*c,* of a modification of the third embodiment of the fuse.

According to FIGS. 7*a–c,* a number of combustible elements 8 are arranged on the outsides of the ribs 4 (which are continuous in the longitudinal direction) of the supporting body 2, to be precise in such a way that each of them is crossed once by the (in this case) two fuse elements 6 which are wound around the supporting body 2 in the form of helical lines, while the combustible elements 8 which follow one another in the longitudinal direction are spaced apart from one another. The ribs 8 can be provided on the outsides with grooves 10 which hold the combustible elements 8. The combustible elements 8 may, however, also be designed (FIG. 7*d*) to be somewhat broader and flat, and merely such that they are applied to the outsides of the ribs 4.

There are, of course, other possible arrangements of the combustible elements. For example, they can surround the supporting body in a number of rings which follow one another axially. Instead of being strips, the fuse elements may be in the form of wires, preferably with constrictions which follow one another at regular intervals, etc.

When a large overcurrent occurs, which is equivalent to at least five times the rated current and reaches the disconnection current at a predetermined voltage in accordance with IEC 282-1—such overcurrents are caused in particular by short circuits—the at least one fuse element 6 melts through very quickly at the constrictions 7, so that a series of relatively short arcs are produced. By addition of the footpoint voltages of the large number of serial arcs, the voltage across the fuse is raised above the system voltage, and the arc is extinguished.

When a small overcurrent occurs, normally above about 1.1 times the rated current—however, the thermal conditions also need to be taken into account—the at least one fuse element 6 is, in contrast, heated relatively quickly to the ignition temperature of the combustible compound which, at least for those parts of the combustible element 8 which are in contact with the fuse element 6, causes the oxidant to release a sufficient amount of oxygen such that the combustion process starts. The heat which is released locally in consequence then very quickly leads to ignition of the entire combustible element or, if appropriate, of the number of combustible elements. In consequence, the fuse element or the fuse elements is or are melted over the entire length, so that one longer arc is formed. Once the combustible material has burnt away, it emits a large amount of heat to the surrounding extinguishing mediums. This results in the plasma being cooled down and the resistance of the arc increasing until its voltage reaches the system voltage and the arc is extinguished.

The fuse thus responds reliably even to small overcurrents, but also reliably interrupts large overcurrents. It thus represents a multi-range fuse which can be used for many purposes.

While the present invention has been described by reference to the above-mentioned embodiments, certain modifications and variations will be evident to those of ordinary skill in the art. Therefore the present invention is to be limited only by the scope and spirit of the appended claims.

What is claimed is:

1. A fuse having a first electrical connection and a second electrical connection, at least one fuse element composed of electrically conductive, fusible material, which connects the first electrical connection to the second electrical connection, a combustible element, which can be ignited and is composed of a combustible material which contains a fuel and an oxidant which, on reaching at an ignition temperature, react with one another releasing heat, wherein the ignition temperature is at most 260° C., and the proportion of oxidant in the combustible material is overstoichiometric.

2. The fuse as claimed in claim 1, wherein the fuel contains a guanidine or guanidine derivative.

3. The fuse as claimed in claim 1, wherein the fuel comprises an additive which is composed of at least one of the following materials: Mg, Al, Zr, Hf, or Th.

4. The fuse as claimed in claim 1, wherein the oxidant is composed essentially of at least one material from one of the following material groups: nitrates, chlorates, perchlorates, and permanganates.

5. The fuse as claimed in claim 4, wherein the oxidant is composed essentially of at least one of the following materials: $KNO_3$, $NaNO_3$, $NH_4NO_3$, $KClO_4$, $NaClO_4$, $KMnO_4$.

6. The fuse as claimed in claim 3, wherein the oxidant contains a metal oxide which enters into a thermitic reaction with at least one constituent of the additive.

7. The fuse as claimed in claim 1, wherein the ratio between the oxidant and the fuel is overstoichiometric by a factor of at least 1.1.

8. The fuse as claimed in claim 1, wherein the combustible material contains a binding agent.

9. The fuse as claimed claim 1, wherein the combustible material is of a composition such that at least 200 J/g of heat is released during its combustion.

10. The fuse as claimed in one of claim 1, wherein the combustible material is of such a composition that a temperature of at least 1700° C. is reached during its combustion.

11. The fuse as claimed in claim 1, wherein the at least one fuse element has constrictions which follow one another, and are spaced apart.

12. The fuse as claimed in claim 1, wherein the at least one combustible element extends essentially over the entire length of the fuse, and the at least one fuse element makes contact with the at least one combustible element at least in places, over its entire length.

13. The fuse as claimed in claim 12, wherein the at least one fuse element essentially makes contact continuously with the at least one combustible element, over its entire length.

14. The fuse as claimed in claim 13, wherein the at least one combustible element is in the form of a continuous layer on the at least one fuse element.

15. The fuse as claimed in claim 11, wherein the fuse element is completely surrounded by combustible material at the constrictions.

16. The fuse as claimed in claim 13, wherein the at least one combustible element is in the form of a flexible tube and surrounds the fuse element.

17. The fuse as claimed in claim 13, at least one the fuse element and the at least one combustible element are jointly surrounded by a flexible tube.

18. The fuse as claimed in claim 11, wherein the at least one combustible element is in the form of a strip and extends essentially over the entire length of the fuse, in such a way that it crosses the at least one fuse element.

19. The fuse as claimed in claim 18, wherein the at least one combustible element comprises a base strip, onto which combustible material is applied.

20. The fuse as claimed in claim 1, further comprising it comprises a supporting body having essentially radially projecting ribs, which cross the at least one fuse element, and the at least one combustible element is arranged on the outside of a rib, in such a way that it makes contact with the at least one fuse element.

21. The fuse as claimed in claim 20, wherein the combustible at least one element is arranged in a groove which is incorporated on the outside of the rib.

22. The fuse as claimed in claim 2, wherein the fuel is composed essentially of at least one of: guanidine, GZT, guanidine acetate, or guanidine nitrate.

23. The fuse as claimed in claim 7, the ratio is over stoichiometric by a factor of at least 10.

24. The fuse as claimed in claim 8, wherein the binding agent comprises polyethylene or an elastomer.

25. The fuse as claimed in claim 8, wherein the binding agent comprises silicone or an elastically modified thermosetting plastic.

26. The fuse as claimed in claim 8, wherein the binding agent comprises a paraffin or a thermoplastic.

27. The fuse as claimed in claim 9, wherein the composition of the combustible material is such that at least 300 J/g of heat is released during its combustion.

28. The fuse as claimed in claim 18, wherein the at least one combustible element crosses the at least one fuse element a plurality of times.

* * * * *